US008919885B2

(12) United States Patent
Han

(10) Patent No.: US 8,919,885 B2
(45) Date of Patent: Dec. 30, 2014

(54) SIMPLE SELF-ASSEMBLY CHAIR FOR HEALTH

(76) Inventor: Kyung Hee Han, Yongin-si (KR)

( * ) Notice: Subject to any disclaimer, the term of this patent is extended or adjusted under 35 U.S.C. 154(b) by 0 days.

(21) Appl. No.: 14/115,692

(22) PCT Filed: Apr. 20, 2012

(86) PCT No.: PCT/KR2012/003051

§ 371 (c)(1),
(2), (4) Date: Nov. 5, 2013

(87) PCT Pub. No.: WO2012/157854

PCT Pub. Date: Nov. 22, 2012

(65) Prior Publication Data

US 2014/0084658 A1 Mar. 27, 2014

(30) Foreign Application Priority Data

May 19, 2011 (KR) ..... 10-2011-0047503

(51) Int. Cl.
*A47C 7/02* (2006.01)
*A47C 3/00* (2006.01)
*A47C 4/02* (2006.01)

(52) U.S. Cl.
CPC ... *A47C 3/00* (2013.01); *A47C 4/02* (2013.01); *A47C 7/021* (2013.01)
USPC ..... 297/440.22; 297/440.1; 297/452.24

(58) Field of Classification Search
USPC ..... 297/440.1, 440.22, 445.1, 452.24
See application file for complete search history.

(56) References Cited

U.S. PATENT DOCUMENTS

| | | | | | |
|---|---|---|---|---|---|
| 2,333,073 | A * | 10/1943 | Mueller | ..... | 297/440.23 |
| 4,302,048 | A * | 11/1981 | Yount | ..... | 297/440.1 |
| 4,563,040 | A * | 1/1986 | Alster | ..... | 297/440.1 |
| 6,749,265 | B1 * | 6/2004 | Wang | ..... | 297/440.1 |
| 2004/0051365 | A1 * | 3/2004 | Darst et al. | ..... | 297/440.1 |

FOREIGN PATENT DOCUMENTS

| | | |
|---|---|---|
| KR | 20-1992-0002671 | 4/1992 |
| KR | 20-0137150 | 4/1999 |
| KR | 20090013321 | 2/2009 |
| KR | 20100043589 | 4/2010 |
| KR | 2020100011849 | 12/2010 |

* cited by examiner

*Primary Examiner* — Milton Nelson, Jr.
(74) *Attorney, Agent, or Firm* — IPLA P.A.; James E. Bame

(57) ABSTRACT

A self-assembly chair for health comprises at least two pairs of leg members which are formed such that trenches are formed in parallel with each other at a coaxial part; at least two horizontal members which are inserted into the trenches formed on each pair of the leg members, and in which protrusions are formed upwardly; a seat member having openings through which the protrusions of the horizontal members are penetrated; armrest members which have concave grooves into which upper ends of the leg members are inserted on the upper part of the leg members, and have one end on which horizontal grooves are formed; and a backrest member in which protrusions inserted into the horizontal grooves of the armrest members are protruded therefrom.

7 Claims, 3 Drawing Sheets

SIMPLE SELF-ASSEMBLY CHAIR FOR HEALTH

BACKGROUND

The present invention relates to a self-assembly chair, and more particularly, to a simple self-assembly chair for health which is mechanically assembled without a separate fixing tool such that anyone can easily assemble the chair, and which includes air holes formed in a seat member and a backrest member that are in contact with a user's body, thereby preventing generation of secretions, such as sweat.

In general, a self-assembly chair includes: a leg rotatably disposed on a rotational shaft disposed at the center such that the chair is foldable when the leg is rotated; and a backrest fixed at one end portion of the leg for supporting a user's back in a state where the chair is unfolded.

However, in order to make the self-assembly chair foldable, because the backrest is mounted parallel with an extension direction of the leg, it is not easy to mount an armrest.

Therefore, Korean Utility Model Registration No. 440,439 discloses a self-assembly chair which includes a seat plate, a backrest and an armrest assemblable to a metal frame such that the self-assembly chair has the armrest.

However, such a conventional self-assembly chair has a problem in that it requires a separate fixing means for assembly. Moreover, the fixing means is small, and hence, the user cannot assemble the self-assembly chair when he or she loses the fixing means.

Furthermore, the conventional self-assembly chair has another problem in that it is not good in private hygiene because bodily secretions, such as sweat, on the buttocks pollute the seat plate due to non-ventilation in the case that the user sits on the seat plate for a long time because the seat plate or the backrest is sealed.

Additionally, in the case that the seat plate or the backrest is hard, when the user sits on the chair and the hip bones get in contact with the hard seat plate or the hard backrest, the conventional self-assembly chair has a further problem in that the user feels bad in seating and in that the chair may cause a pain when the user sits on the chair for a long time.

SUMMARY OF THE INVENTION

Accordingly, the present invention has been made in an effort to solve the above-mentioned problems occurring in the prior arts, and it is an object of an exemplary embodiment of the present invention to provide a simple self-assembly chair which includes air holes formed in a seat member and a backrest member which are in contact with the buttocks when a user sits on the chair, and thus, the chair can improve a private hygiene environment and protect the user's health.

It is another object of an exemplary embodiment of the present invention to provide a simple self-assembly chair which has the seat member having a depressed surface formed in correspondence with the shape of the buttocks and holes formed at positions where the hip bones get in contact with the seat member so as to relieve conflict between the hip bones and the seat member. The simple self-assembly chair according an exemplary embodiment of the present invention includes an air hole formed at a position corresponding to the anal region to ventilate air, thereby improving the hygiene environment of the buttocks by discharging secretions generated from the user's body and providing the user with cleanness and comfort.

It is a further object of an exemplary embodiment of the present invention to provide a simple self-assembly chair whose components are forcedly assemblable without any separate fixing means.

It is a still further object of an exemplary embodiment of the present invention to provide a simple self-assembly chair which provides the user with comfortability even though the user sits on the chair for a long time because the seat member has the depressed surface formed corresponding with the shape of the buttocks.

It is another object of an exemplary embodiment of the present invention to provide a simple self-assembly chair which includes a sitting cushion having air holes corresponding to the air holes of the seat member, thereby protecting the user's buttocks warm.

It is a further object of an exemplary embodiment of the present invention to provide a simple self-assembly chair which includes trenches located on a concentric axis in a state where leg members in pairs are inclined in the opposite direction, thereby providing stability in structure and durability.

To achieve the above objects, the present invention provides a simple self-assembly chair including: at least two pairs of leg members formed such that trenches are formed in parallel with each other on a concentric axis; at least two horizontal members respectively inserted into the trenches formed on each pair of the leg members, each of the horizontal members having protrusions formed upwardly; a seat member having openings through which the protrusions of the horizontal members respectively penetrate therethrough; armrest members respectively having concave grooves into which protrusions of upper ends of the leg members are respectively inserted, each of the armrest members having a horizontal groove formed at one end thereof; and a backrest member having protrusions respectively fit into the horizontal grooves of the armrest member.

Here, the seat member comprises an upper surface depressed corresponding to the shape of the buttocks.

Moreover, the seat member comprises holes formed at portions which are located in the depressed surfaces corresponding to the shape of the buttocks and at a portion which is located corresponding to the anal region.

Furthermore, the hole formed at the portion which is located corresponding to the anal region is higher than the holes formed at the portions which are located in the depressed surfaces corresponding to the shape of the buttocks such that the holes form a triangle.

Additionally, the simple self-assembly chair further includes a sitting cushion having holes formed at portions which are formed at portions corresponding to the holes of the depressed surfaces formed corresponding to the shape of the buttocks and corresponding to the hole formed at the portion which is located corresponding to the anal region.

In addition, the sitting cushion comprises five pairs of fastening strings are respectively disposed at four edges and a central portion of the sitting cushion.

Moreover, the trenches respectively formed in the leg member are located on the concentric axis in the state where the leg members in pairs are inclined in the opposed direction.

The simple self-assembly chair according to the exemplary embodiment of the present invention can be easily assemblable without any separate fixing means because it adopts a forcedly fitting structure.

In addition, the simple self-assembly chair according to the exemplary embodiment of the present invention provides the user with comfort even though the user sits on the chair for a long time because it has the depressed surface corresponding to the shape of the buttocks.

Furthermore, the simple self-assembly chair according to the exemplary embodiment of the present invention can improve private hygiene environment and protect the user's health because the seat member has the air holes for preventing sweat.

Additionally, the simple self-assembly chair according to the exemplary embodiment of the present invention can protect the user's buttocks warm because the chair includes the sitting cushion having the air holes corresponding to the air holes of the seat member.

In addition, the simple self-assembly chair according to the exemplary embodiment of the present invention provides stability in structure and durability because the trenches are located on the concentric axis in the state where the leg members in pairs are inclined in the opposite direction.

DETAILED DESCRIPTION OF THE INVENTION

Reference will be now made in detail to the preferred embodiment of the present invention with reference to the attached drawings.

Figure 1:
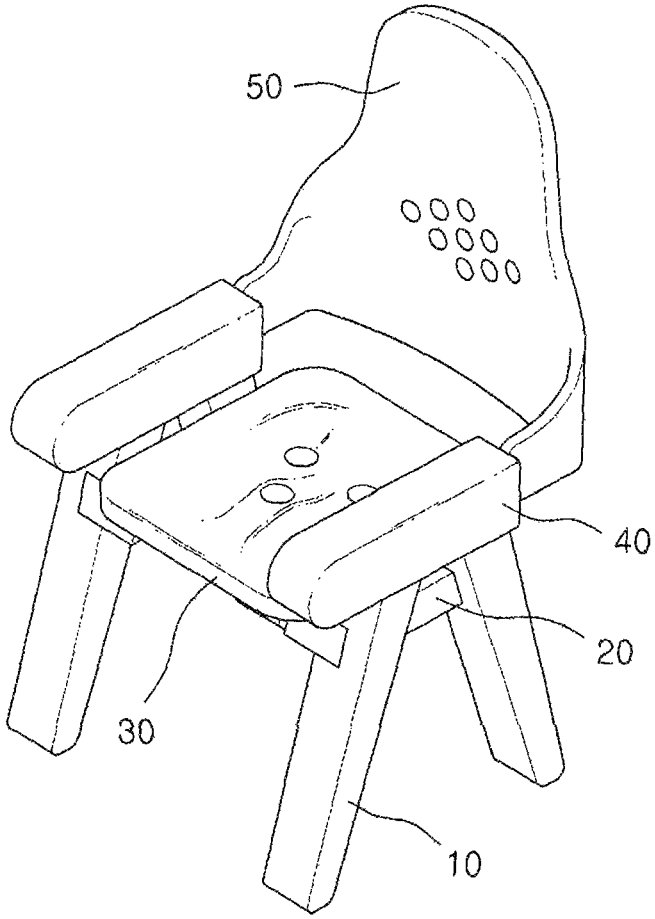
FIG. 1 is a perspective view showing a self-assembly chair according to an exemplary embodiment of the present invention.
Figure 2:
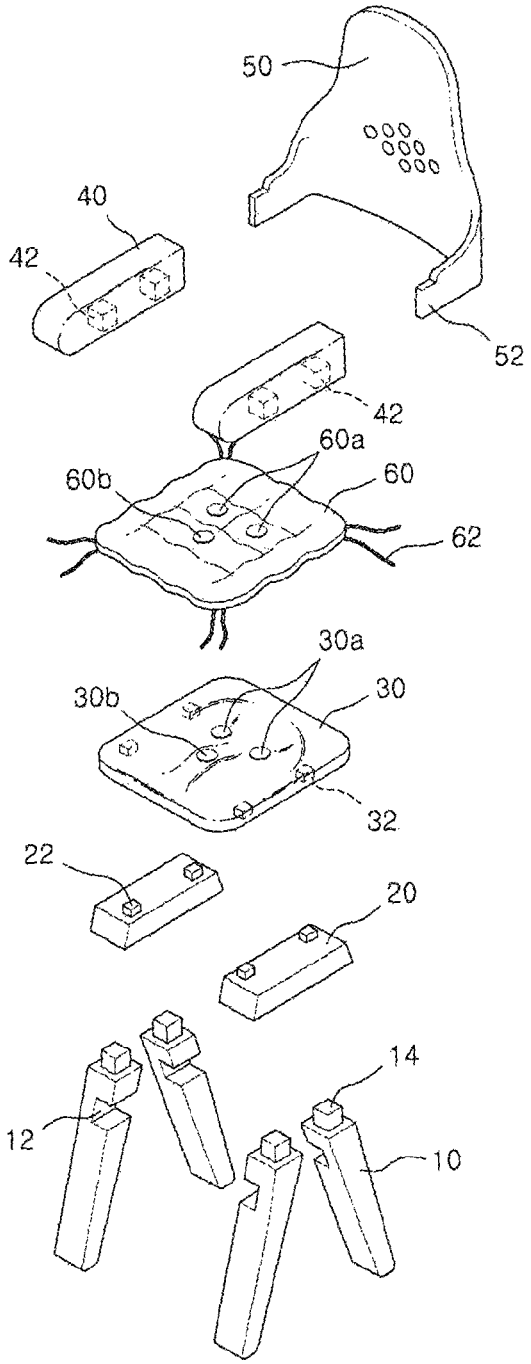
FIG. 2 is an exploded perspective view of the self-assembly chair according to the exemplary embodiment of the present invention.
Figure 3:
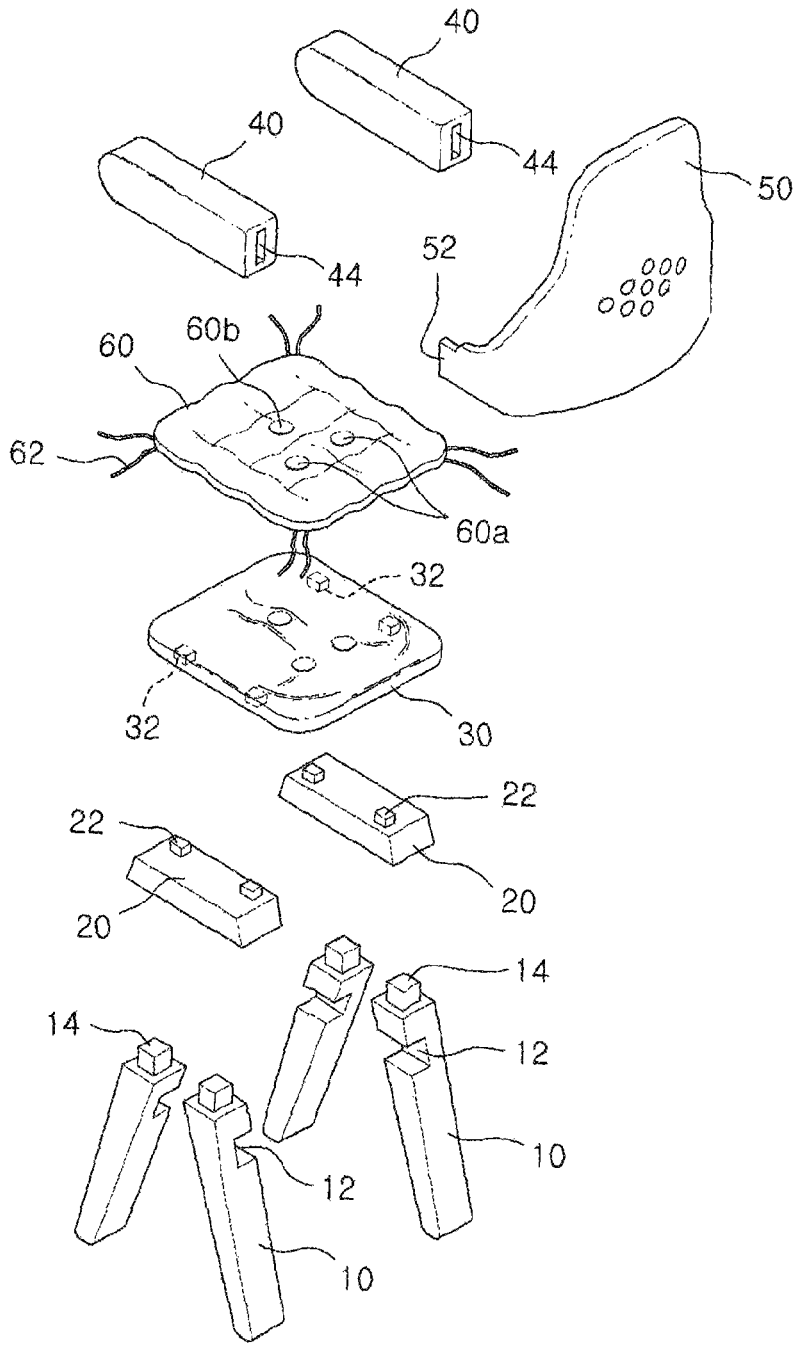
FIG. 3 is an exploded perspective view showing a state where the self-assembly chair according to the exemplary embodiment of the present invention is viewed from another direction.

As shown in FIGS. 1 to 3, a self-assembly chair according to an exemplary embodiment of the present invention includes: at least two pairs of leg members 10 formed such that trenches 12 are formed in parallel with each other on a concentric axis; at least two horizontal members 20 respectively inserted into the trenches 12 formed on each pair of the leg members 10, each of the horizontal members 20 having protrusions 22 formed upwardly; a seat member 30 having openings 32 through which the protrusions 22 of the horizontal members 20 respectively penetrate therethrough; armrest members 40 respectively having concave grooves 42 into which protrusions 14 of upper ends of the leg members 10 are respectively inserted, each of the armrest members 40 having a horizontal groove 44 formed at one end thereof; and a backrest member 50 having protrusions 52 respectively fit into the horizontal grooves 44 of the armrest member 40.

Each of the leg members 10 extends in a longitudinal direction and has the trench 12 formed in the middle in such a way as to be cut at one side. At least two pairs of the leg members 10 are disposed such that they can be forcedly fit by the horizontal members which are assembled side by side. It is preferable that lower portions of the leg members 10 be rounded so as to prevent a gap between the leg member and the ground after the leg members are assembled and put on the ground. Here, it is preferable that each of the leg members 10 have the protrusion 14 which is formed at the upper end thereof and is smaller in size than the upper end of the leg member. Moreover, it is preferable that the trenches 12 respectively formed in the leg member 10 are located on the concentric axis in the state where the leg members 10 in pairs are inclined in the opposed direction. Therefore, when the trenches 12 are located on the concentric axis, the chair is stable in structure and enhances durability because an interval between the corresponding leg members 10 becomes wider downwardly.

The horizontal members 20 are forcedly fit into the trenches 12 formed in the leg members 10. Therefore, it is preferable that the width of the horizontal members 10 and the breadth of each trench 10 formed in the leg member 10 be constructed such that they are joined together by interference fit. Additionally, each of the horizontal members 20 has the protrusion 22 which will be inserted into the openings 32 of the seat member 30 which will be described later.

The seat member 30 has the openings 32 into which the protrusions 22 of the horizontal members 20 are inserted. Here, it is preferable that the openings 32 and the protrusions 22 of the horizontal members have cross sections corresponding with each other such that the openings 32 and the protrusions 22 are joined together by interference fit. In the case of the conventional self-assembly chair, when the user sits on the hard chair for a long time, the seat member is polluted by sweat generated from the buttocks. Moreover, in the case that the seat member of the conventional chair is made of a hard material, when the user sits on the chair, the chair may cause uncomfortableness and some pain because the hip bones conflict with the surface of the seat member. However, in order to overcome the above problems of the conventional self-assembly chair, the self-assembly chair according to the exemplary embodiment of the present invention includes a depressed surface having the shape corresponding to that of the buttocks and holes 30*b* formed at portions where the hip bones get in contact with the depressed surface of the seat member 30 so as to relieve the conflict between the seat member and the buttocks and to ventilate air. In this instance, because the anal region is higher than the portion where the buttocks get in contact with the seat member, a hole 30*b* is formed at a position higher than the positions of the holes 30*a* corresponding to the buttocks such that the holes 30*a* and 30*b* forms a triangle as shown in FIG. 4, and thus the self-assembly chair according to the exemplary embodiment of the present invention provides the user with stability because the depressed portions of the seat member 30 correspond with the buttocks and there is no empty space between the buttocks and the seat member when the user sits on the chair. Additionally, the self-assembly chair according to the exemplary embodiment of the present invention can provide the user with cleanness and comfort when the user sits on the chair by improving the buttocks' hygiene environment because the chair discharges out secretions, such as sweat, generated from the user's body through the holes 30*a* and 30*b*. Moreover, because the chair promotes the blood circulation, even though the user sits on the chair for a long time, the chair can prevent economy class syndrome which causes difficulty in breathing due to blood clot in the veins of the leg and due to stopping a blood flow of blood cells in the legs or the lung. Therefore, the self-assembly chair according to the exemplary embodiment of the present invention can prevent generation of sweat and improve the private hygiene environment because ventilation is achieved through the holes 30*a* and 30*b* even though the user sits on the chair for a long time. Furthermore, the self-assembly chair according to the exemplary embodiment of the present invention can protect the user's health because it prevents the buttocks from festering by sweat.

The armrest member 40 includes the recesses 42 which are formed in the lower portion of the armrest member 40 and into which the protrusions 14 of the leg members 10 are inserted. The concave grooves 42 are extended in the longitudinal direction such that the upper ends of the leg members 10 are forcedly fit into the recesses 42 even though the leg members 10 are inclined. Furthermore, the armrest member 40 further includes the horizontal groove 44 formed at one end thereof. It is preferable that the protrusions 52 of the backrest member 50 are inserted and fixed into the horizontal grooves 44 of the armrest member 40 by interference fit.

The backrest member 50 includes the protrusions 52 forcedly fit into the horizontal grooves of the armrest members 40. In addition, the backrest member includes a curved portion formed on the rear surface in correspondence with the shape of the user's back so that the user can feel comfort when the user sits on the chair. Moreover, the backrest member 50 further includes through holes for preventing generation of sweat from the user's back.

Furthermore, a sitting cushion 60 is put on the top of the seat member 30. The sitting cushion 60 has air holes 60*a* and 60*b* formed at positions corresponding to the positions of the holes 30*a* and 30*b* of the seat member 30. Therefore, when the sitting cushion 60 is put on the seat member 30, the sitting cushion 60 prevents the buttocks from festering and keeps the buttocks warm. Accordingly, the chair is very helpful for women, the elderly or the infirm who need to keep the buttocks warm.

In this instance, in order to prevent the sitting cushion from movement or separation during the use, it is preferable that fastening strings 62 be attached to four edges and tied to the leg members 10. Here, it is preferable that the fastening strings 62 are attached in pair so that the sitting cushion 60 is easily fastened to the leg members 10.

The simple self-assembly chair according to the exemplary embodiment of the present invention can improve the private hygiene environment and protect the user's health because it includes the air holes formed in the seat member which is in contact with the user's buttocks and the backrest member so as to ventilate well.

The invention claimed is:

1. A simple self-assembly chair comprising:

at least two pairs of leg members formed such that trenches are formed in parallel with each other on a concentric axis;

at least two horizontal members respectively inserted into the trenches formed on each pair of the leg members, each of the horizontal members having protrusions formed upwardly;

a seat member having openings through which the protrusions of the horizontal members respectively penetrate therethrough;

armrest members respectively having grooves into which protrusions of upper ends of the leg members are respectively inserted, each of the armrest members having a horizontal groove formed at one end thereof; and a backrest member having protrusions respectively fit into the horizontal grooves of the armrest member.

2. The simple self-assembly chair according to claim 1, wherein the seat member comprises a depressed upper surface.

3. The simple self-assembly chair according to claim 2, wherein the seat member comprises holes formed in the depressed upper surface.

4. The simple self-assembly chair according to claim 3, wherein the holes formed in the depressed upper surface form a triangle.

5. The simple self-assembly chair according to claim 3, further comprising:

a sitting cushion having holes formed at portions which are formed at portions corresponding to the holes formed in the depressed upper surface.

6. The simple self-assembly chair according to claim 5, wherein the sitting cushion comprises five pairs of fastening strings respectively disposed at four edges and a central portion of the sitting cushion.

7. The simple self-assembly chair according to claim 2, wherein the trenches respectively formed in the leg member are located on the concentric axis in a state where the leg members in pairs are inclined in opposed direction.

* * * * *